United States Patent [19]

Rohrer

[11] 4,115,976

[45] Sep. 26, 1978

[54] METHOD FOR SCREEDING CEMENT

[75] Inventor: Walter J. Rohrer, Kansas City, Kans.

[73] Assignee: John Rohrer Contracting Company, Kansas City, Kans.

[21] Appl. No.: 779,606

[22] Filed: Mar. 21, 1977

[51] Int. Cl.[2] ..... E04G 21/10

[52] U.S. Cl. ..... 52/741; 264/35; 404/119

[58] Field of Search ..... 52/365–367, 52/298, 126, 741, 704–709; 404/118, 119, 135, 136, 106; 264/35; 33/293, 295

[56] References Cited

U.S. PATENT DOCUMENTS

| | | | |
|---|---|---|---|
| 1,460,035 | 6/1923 | Nielsen | 52/704 |
| 1,599,745 | 9/1926 | Cinnamond | 52/365 |
| 1,780,427 | 11/1930 | Kirkham | 404/119 |
| 2,167,176 | 7/1939 | Grassberger | 52/705 |
| 2,306,671 | 12/1942 | Tamblyn | 404/119 |
| 2,867,041 | 6/1959 | McMillan | 52/367 |
| 3,006,115 | 10/1961 | Hillberg | 52/365 |
| 3,065,506 | 11/1962 | Tremer | 52/126 |

FOREIGN PATENT DOCUMENTS

| | | | |
|---|---|---|---|
| 982,822 | 2/1965 | United Kingdom | 404/119 |

*Primary Examiner*—James L. Ridgill, Jr.
*Attorney, Agent, or Firm*—Fishburn, Gold & Litman

[57] ABSTRACT

A screed support and method for screeding cement comprises digging a plurality of arranged holes in the bed surface of the area to be cemented. Unsolidified cement is poured into each of the holes, a hollow sleeve is inserted into the wet cement and positioned therein in a substantially vertical orientation, and the cement is cured to a solidified state. A rail support member having a threaded rod and a mating, adjustable collar, is telescopically inserted into each of the sleeves. Screed support rails are connected with each rod, and the elevation and inclination of the same is adjusted in infinitely small increments by manipulating each collar in accordance with the desired, predetermined requirements. Additional unsolidified cement is then poured between the rails, and a self-propelled screeding machine is passed thereover to smoothen and level the uneven free surface of the additional cement. Before the additional cement hardens, the rails are disconnected from the support members and the collar and rod assemblies are extracted from the sleeves.

4 Claims, 6 Drawing Figures

METHOD FOR SCREEDING CEMENT

This invention relates to an apparatus and method for screeding cement, and in particular to a screed rail support and method for screeding large cement slabs.

Recently developed cement compositions, such as those marketed under the trademark "Chem-Comp," have a greatly reduced coefficient of thermal expansion. As a result, very large continuous areas of concrete such as roads, floors, and the like, can be poured without the need for numerous expansion spaces, grooves, or the like. The present invention is particularly adapted for use with the above noted cement compositions, and provides an improved screed support, adjustable in infinitely small increments, as well as a method for screeding the cement which decreases screed support setup and removal time, and achieves greater leveling accuracy.

The principal objects of the present invention are: to provide a screed support and method for screeding cement having means for adjusting the vertical elevation of the rails in infinitely small increments; to provide such an apparatus which includes a threaded rod and collar assembly telescopically positioned within a ground engaging sleeve for easy and economical screed support assembly and removal; to provide such an apparatus wherein a self-propelled screeding machine is passed over said rails and said sleeve is retained in solidified cement for accurate, planar, leveling; to provide such an apparatus having a T-shaped rail for improved screed support removal; to provide such an apparatus having a fork-shaped bracket abuttingly receiving and supporting said rail therein for speedy assembly and disassembly; to provide such a method wherein a flanged pole is provided for inserting and positioning said sleeve within said cement; and to provide such an apparatus which is economical to manufacture, efficient in use, capable of a long operating life, and particularly well adapted for the proposed used.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
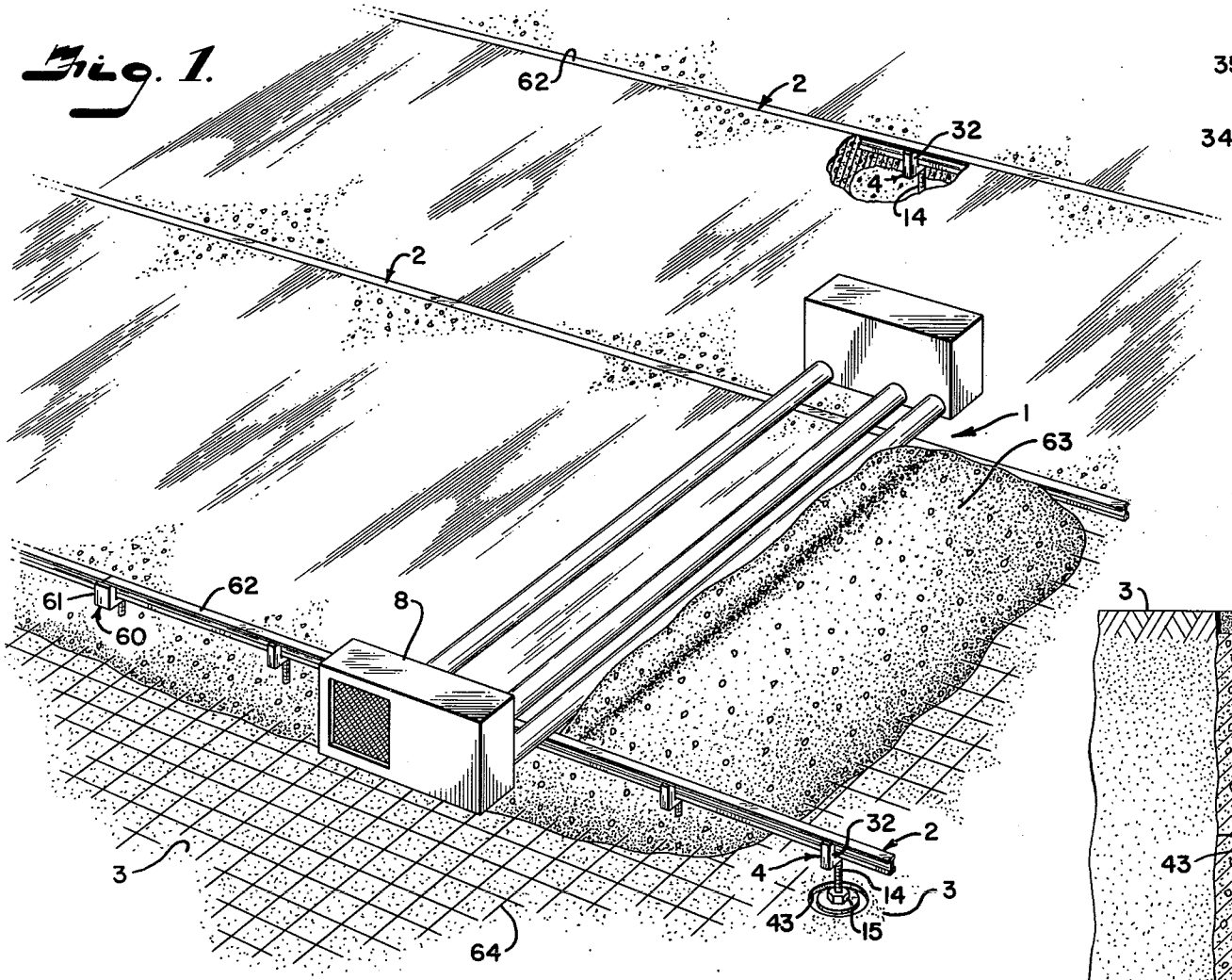
FIG. 1 is a fragmentary perspective view of a screed support and illustrates a method for screeding cement, both embodying the present invention.
Figure 6:
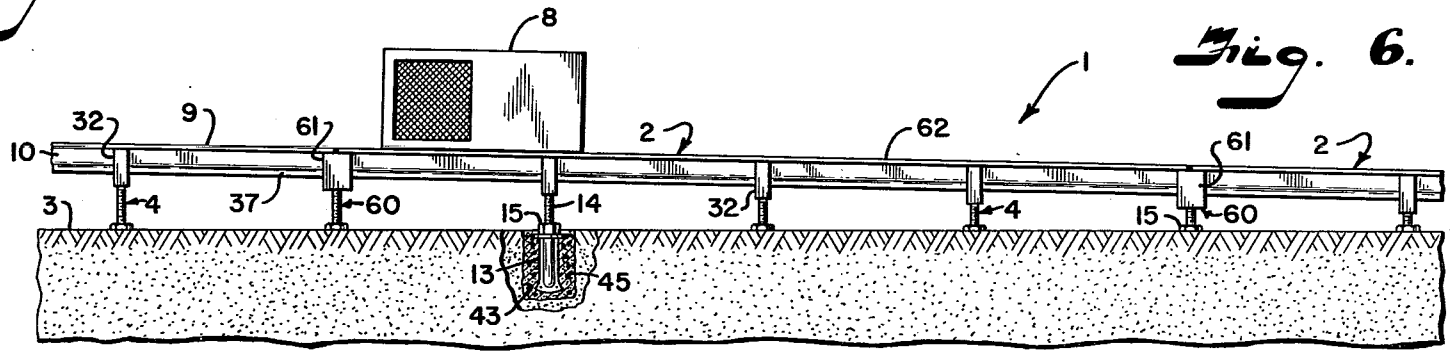
FIG. 6 is a fragmentary side elevational view of the screed support, shown arranged for screeding an inclined floor surface.

The reference numeral 1 generally designates a screed support embodying the present invention and comprising elongate rails 2 supported above the bed surface 3 of the area to be cemented by a plurality of vertically adjustable rail supports 4. The rails 2 are sufficiently rigid to support heavy screeds thereon, such as the self-propelled screeding machine 8 illustrated in FIGS. 1 and 6, without substantial deflection. Each of the illustrated rails 2 has a T-shaped transverse cross section and includes a flange 9 and a web 10 depending from a medial portion thereof. The rails are preferably constructed of a metal such as aluminum or steel. Each side of the screed 8 is supported by several rail segments which are positioned in an end-to-end fashion and separably interconnected.

Figure 2:
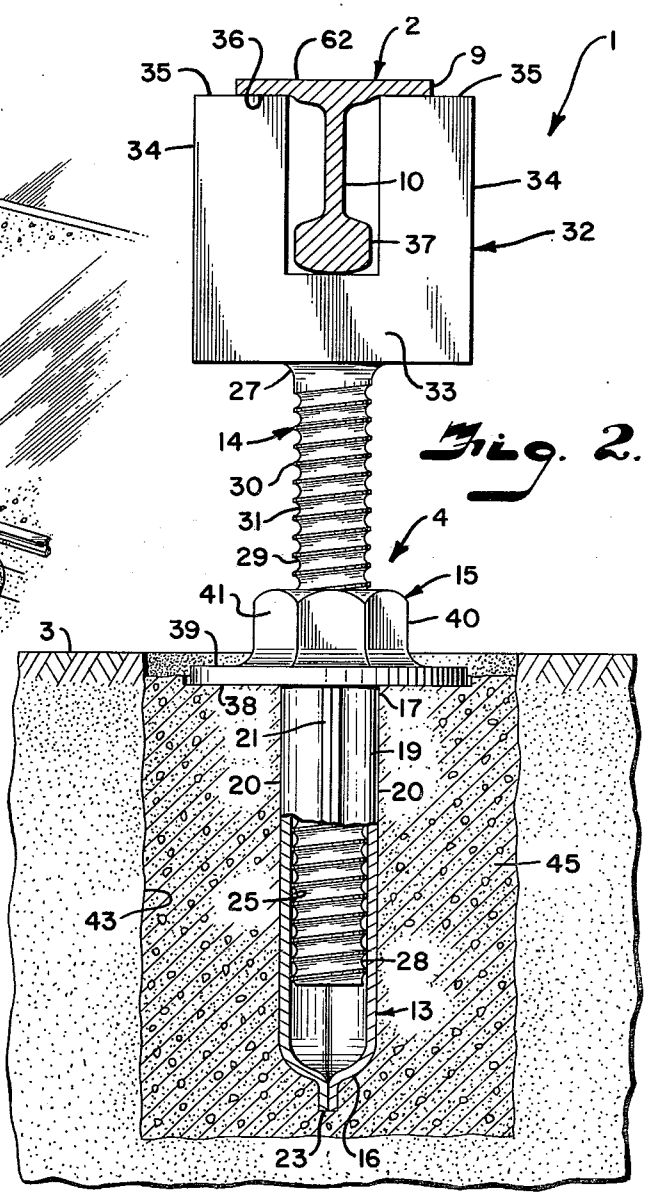
FIG. 2 is an enlarged elevational view of an adjustable screed rail support having a rail positioned therein, including a sleeve member thereof imbedded in solidified cement.
Figure 3:
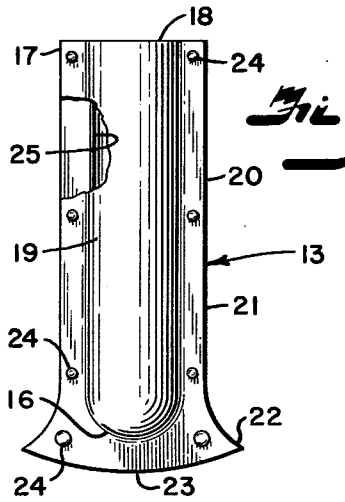
FIG. 3 is a side elevational view of the rail support sleeve member.

The rail support members 4 each comprise a sleeve 13, an elongate rod 14 and an internally threaded collar 15. The sleeve 13 includes a closed end 16, an open end 17 with a terminal edge 18, and an outer surface 19 shaped for insertion into unsolidified cement. The sleeve 13 illustrated in FIGS. 2 and 3 comprises a pair of hemilaterally shaped body portions 20 constructed of a sheet material, each having a flange 21 extending about the marginal edge thereof and providing a surface for attaching the same together. The lower end 22 of the flange is enlarged and includes an arcuately shaped terminal edge 23. The two body portions are connected by fastening means such as bolts, rivets, or the illustrated spot welds 24, disposed along the body portion flanges in a spaced apart and regular manner. The two body portions 20 form a substantially watertight, cylindrically shaped cavity 25 thereinbetween, which is adapted for receiving the rod 14 telescopically therein. When the support is used in conjunction with concrete filled holes in the floor bed surface, the flange 21 and edge 23 functions as a guide for inserting the sleeve into the cement, and as an anchor for the sleeve when the cement solidifies.

The rod 14 is an elongate and rigid structure, having the upper end 27 thereof connected with the rail 2, and the lower end 28 thereof positioned slidingly and telescopically within the sleeve cavity 25. The medial portion 29 of the rod 14 is helically threaded, and the outermost surfaces of the threads are adapted to mate with the inside surface of the sleeve cavity. In this example, the rod 14 is threaded along its entire length, and the thread design is very coarse, having an arcuately shaped root 30, a flat crest 31, and a pitch in the nature of 2/7 inches. A fork shaped bracket 32 is connected with the upper rod end 27 and includes a transverse central member 33 and a pair of opposed, spaced apart prongs 34 upstanding thereform. Each of the prongs 34 has a flat, upper supporting surface 35 for abutting the lower surface 36 of the rail flange 9. The lower surface of the rail web 10 rests upon the central member 33. In the illustrated structure, the bracket 32 is rigidly attached to the upper rod end 27 to facilitate vertical adjustment of the support member, and the lower end 37 of the web is enlarged and positions the rail between the bracket prongs 34, allowing clearance on each side thereof for adjustment and insertion ease.

The collar 15 is internally threaded and is threadedly connected with the medial portion 29 of the rod 14. A lower surface 38 of the collar 15 abuts the terminal edge 18 of the sleeve open end 17, whereby rotation of the collar with respect to the rod slidingly translates the rod in the sleeve and adjusts the elevation and inclination of the rail in infinitely small increments. The illustrated collar 15 includes an annular disk 39, and an internally threaded sleeve 40 connected with the upper surface thereof. The sleeve 40 has an outer marginal surface 41 shaped for grasping, which, in this example, is in the shape of a hexagonally shaped nut. The rod 14, collar 15 and bracket 32 are preferably constructed of a rigid, durable material such as steel.

Figure 5:
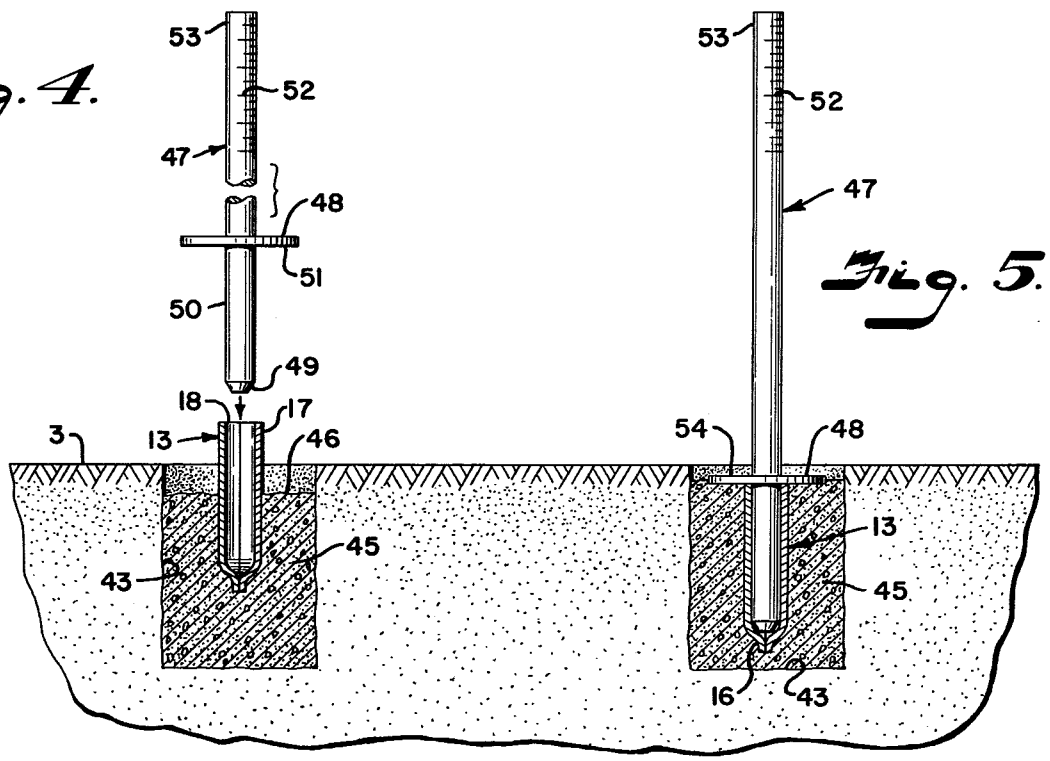
FIG. 5 is a fragmentary vertical cross-sectional view of the support sleeve, and illustrates a method for inserting the same into wet cement.

A method for screeding cement floors embodying the present invention includes digging a plurality of holes 43 in the ground or bed surface 3. The holes 43 are arranged in at least two substantially parallel and spaced apart rows 44, wherein the holes in each row are spaced apart and generally aligned. The location of each hole is laid out on the bed surface 3 in a conventional manner, such as with measuring tapes and chalk markings. The illustrated holes are relatively shallow in depth, in the order of 4 to 18 inches, and are preferably formed by a mechanical drilling machine such as that used to dig post holes. A sleeve 13 is positioned and retained in each hole 43 by means such as mortar, grout and the like, and in this example, wet cement 45 is poured into each of the holes to a level substantially below the bed surface 3. A sleeve 13 is then positioned into each of the holes 43 in a substantially vertical orientation with the closed end 16 of the sleeve positioned downwardly within the cement, and the open end 17 extending slightly above the free surface 46 of the cement. The cement is then cured to a hardened or solidified state. As illustrated in FIG. 5, insertion of the sleeves into the wet cement may be practiced by providing a pole 47 having a flange 48 attached thereto at a point spaced apart from the lower end 49 of the pole. A terminal portion 50 of the pole telescopically mates with the sleeve cavity 25, and the flange 48 is positioned therealong, such that the lower surface 51 thereof engages the terminal edge 18 of the sleeve. Longitudinally graduated measuring indicia 52 is disposed along the upper end 53 of the pole. The terminal portion 50 of the pole is inserted within a sleeve 13 partially embedded in the cement, with the flange 48 engaging the sleeve terminal edge 18, and the assembly is pushed downwardly into the unsolidified cement. The vertical inclination and depth of the sleeve is adjusted by sighting on the graduated measuring indicia 52 with well known means such as a transit. In this example, the flange 48 is circular, having a diameter equal to or slightly larger than that of the collar 15, and is partially imbedded into the unsolidified cement creating an indentation with a flat circular area 54 in the free surface thereof. The pole 47 is then withdrawn from the sleeve 13 and the cement is cured to a solidified state. A rod 14 with threaded collar thereon is then telescopically inserted into each of the sleeves such that the lower surface of the collar abuts and is adjustably supported by the terminal edge 18 of the sleeve. When the pole 47 is employed in the above described sleeve insertion method, a flat circular area 54 has been formed in the upper surface of the cement, and the lower surface 38 of the collar 15 abuts the same and is partially supported thereby. In this embodiment, the sleeve 13 may be constructed of a less rigid and more economical material such as a cardboard cylinder (not shown) having the lower end thereof pinched closed. The rails 2 are connected with the rail supports 4 by positioning the same between the upstanding prongs 34 of each of the brackets 32. A joining support member 60, having an elongated support bracket 61, is provided to support adjacent, end-to-end rail segments. The elevation and inclination of each of the rails 2 is then adjusted by sighting the leveling instrument on the top surface 62 of each of the rails, and manually rotating the adjustable collars in accordance with the desired parameters. The rails may be so adjusted to fabricate an inclined floor such as that illustrated in FIG. 6.

Additional unsolidified cement is then poured into the floor bed surface 3 between adjacent parallel rails to a height slightly above the upper surface 62 of the rails. The cement is transported thereto by conventional means such as a wheelbarrow, a chute or a slurry pump, and has an uneven upper free surface 63, and in this example is reinforced by wire mesh 64. The screed 8 is then passed over the upper surface of each rail such that the uneven upper free surface 63 of the additional unsolidified cement is rendered smooth and planar. Although the self-propelled screeding machine has considerable weight, the supports do not settle as the machine passes thereover, thereby alleviating undulations and deviations from the desired level of the floor. The rails 2 are then separated from the support members and removed to a remote location, and the rods and collars connected therewith are extracted from each of the sleeves 13. The apertures in the unsolidified cement 4 created by the removal of the rails and the support members is patched and rendered smooth during the finishing process.

Figure 4:
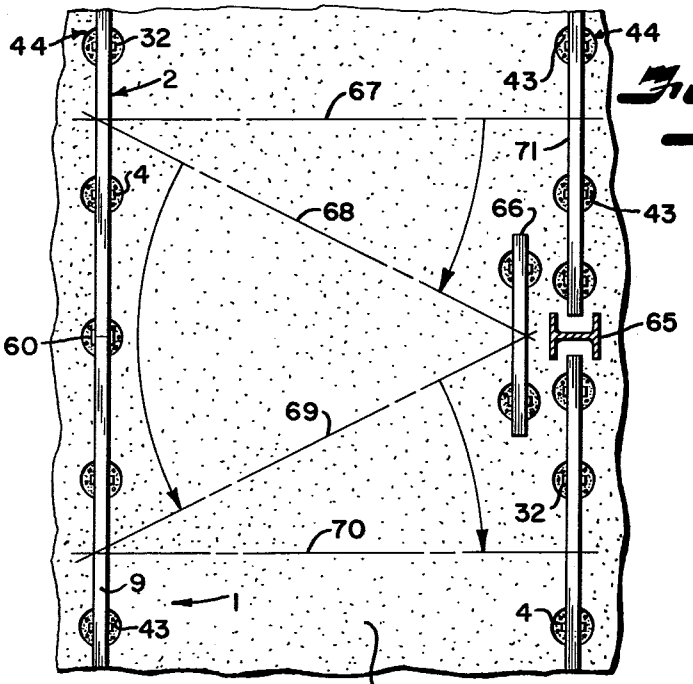
FIG. 4 is a fragmentary top plan view of the screed support, shown arranged for leveling cement around a structural building column.

The present invention also contemplates means for screeding cement around an object protruding from the bed surface 3, such as a building structural column 65 (FIG. 4). To screed around such obstructions, the floor bed 3 is first laid out with the rails 2 positioned on center with the building column(s) 65. The rail segments are then installed with the ends thereof adjacent to the column. A relatively short segment of rail 66 is then disposed along the inward side of the column, and is supported by adjustable rail supports 4. The rail segment 66 is leveled in the same manner as the other rails. The screed 8 is piloted over the rails until the screed is positioned adjacent to the column 65. The screed is then reversed to a position illustrated by the line 67; pivoted in sequence along the path illustrated by the lines 68, 69 and 70; and then continues its normal, forward motion. The end of the screed associated with the obstructed rail 71 is supported by rail segment 66 during the pivoting of the screed.

It is to be understood that while I have illustrated and described certain forms of my invention, it is not to be limited to the specific forms or arrangement of parts herein described and shown.

What I claim and desire to secure by Letters Patent is:

1. In a method for screeding cement floors to a desired level with a self-propelled screeding machine, including providing an area of ground with an aggregate bed surface thereover, and a pair of rails for supporting each side of said screeding machine above said aggregate bed surface, the improvement comprising:

(a) digging a plurality of holes through said aggregate bed surface into the ground; said holes being arranged in at least two substantially parallel and spaced apart rows wherein the holes in each row are spaced apart and generally aligned;

(b) pouring unsolidified cement into each of said holes;

(c) inserting an open ended sleeve in a substantially vertical orientation in the unsolidified cement in each of said holes; positioning a closed end of said sleeve downwardly within said cement, and positioning an open end of said sleeve in a position communicating with the area above the free surface of said cement;

(d) curing said cement to a solidified state, thereby forming a cement footing around each sleeve and fixedly setting the same in said bed surface;

(e) inserting a rail support member telescopically into each sleeve; said support member including an upper end; and (f) connecting said rails to the upper end of each support member whereby the weight of said screeding machine does not settle said support members and cause undulations and deviation from the desired level of said floor.

2. A method for screeding cement floors comprising the steps of:

(a) providing a floor bed surface and a screed;

(b) digging a plurality of rail support holes in said bed surface; said holes being arranged in at least two substantially parallel and spaced apart rows wherein the holes in each of said rows are spaced apart and generally aligned;

(c) pouring unsolidified cement into each of said holes;

(d) positioning a sleeve in each of said holes; said sleeve being positioned in a substantially vertical orientation and having an open end with a terminal edge thereof extending above the free surface of said cement, and a closed end thereof positioned downwardly within said cement;

(e) curing said cement to a solidified state;

(f) inserting a rail support member telescopically into each of said sleeves; said support member including a threaded, vertically adjustable collar abutting the terminal edge of said sleeve open end and adjustably supporting said support member in said sleeve;

(g) connecting an elongate rail to each rail support member in each of said rows; each rail having an upper surface;

(h) adjusting the elevation and inclination of each of said rails by manipulating said adjustable collars;

(i) pouring additional unsolidified cement onto said floor bed surface between said rows to a height slightly above said rail upper surface; said additional unsolidified cement having an uneven upper free surface;

(j) passing said screed over said rail upper surface whereby the uneven upper free surface of said additional unsolidified cement is rendered smooth and planar;

(k) disconnecting said rails from said support members and removing the same to a remote location;

(l) extracting said support member from each sleeve; and wherein (m) said screed is a self propelled screeding machine;

(n) said sleeve inserting includes imbedding a portion of said collar in said unsolidified cement and creating an indentation with a flat circular area in the free surface therof; and (o) said rail support member collar is positioned within said indentation and partially supported by said flat circular area thereof.

3. A method for screeding cement floors comprising the steps of:

(a) providing an area of ground with an aggregate bed surface thereover and a self-propelled screeding machine;

(b) digging a plurality of rail support holes in said bed surface; said holes being arranged in at least two substantially parallel and spaced apart rows wherein the holes in each of said rows are spaced apart and generally aligned;

(c) pouring unsolidified cement into each of said holes;

(d) inserting an open ended sleeve in a substantially vertical orientation in the unsolidified cement in each of said holes; positioning a closed end of said sleeve downwardly within said cement, and positioning an open end of said sleeve in a position communicating with the area above the free surface of said cement;

(e) curing said cement to a solidified state, thereby forming a cement footing around each sleeve and fixedly setting the same in said bed surface;

(f) inserting a rail support member telescopically into each of said sleeves; said support member including a threaded, vertically adjustable collar abutting the terminal edge of said sleeve open end and adjustably supporting said support member in said sleeve;

(g) connecting an elongate rail to each rail support member in each of said rows; each rail having an upper surface;

(h) adjusting the elevation and inclination of each of said rails by manipulating said adjustable collars;

(i) pouring additional unsolidified cement onto said floor bed surface between said rows to a height slightly above the upper surface thereof; said additional unsolidified cement having an uneven upper free surface;

(j) passing said self propelled screeding machine over the upper surface of each rail whereby the uneven upper free surface of said additional unsolidified cement is rendered smooth and planar;

(k) disconnecting said rails from said support members and removing the same to a remote location; and (l) extracting said support member from each sleeve.

4. A method as set forth in claim 3 including (a) screeding around an obstruction protruding from the ground including the steps of:

(1) locating one of said rows in alignment with said obstruction;

(2) positioning separate rails on either side of said obstruction and supporting said separate rails by associated sleeve and rail support members;

(3) providing a short rail segment and positioning the same adjacent an inside surface of said projection; said short rail being supported by associated sleeve and rail support members;

(4) piloting said self-propelled screeding machine over said rails to a point adjacent said obstruction; said screeding machine having a first screed end disposed in line with said obstruction and a second screed end positioned remotely thereof;

(5) reversing said screeding machine to a position spaced from said obstruction;

(6) pivoting the first screed end about the second screed end, whereby said first screed end is supported by said short rail segment;

(7) pivoting the second screed end about the first screed end to a point wherein said obstruction is outside of the rotational path of said first screed end; and (8) pivoting the first screed end about the second screed end to a position wherein said screeding machine is disposed substantially perpendicular to said rails.

* * * * *